US012371807B2

(12) United States Patent
Ijeri et al.

(10) Patent No.: US 12,371,807 B2
(45) Date of Patent: Jul. 29, 2025

(54) ALUMINUM AND ALUMINUM ALLOY ELECTROPLATED COATINGS

(71) Applicant: THE BOEING COMPANY, Arlington, VA (US)

(72) Inventors: Vijaykumar S. Ijeri, Mumbai (IN); Om Prakash, Bangalore (IN); Stephen P. Gaydos, St. Louis, MO (US)

(73) Assignee: THE BOEING COMPANY, Arlington, VA (US)

( * ) Notice: Subject to any disclaimer, the term of this patent is extended or adjusted under 35 U.S.C. 154(b) by 48 days.

(21) Appl. No.: 18/144,482

(22) Filed: May 8, 2023

(65) Prior Publication Data

US 2023/0392275 A1 Dec. 7, 2023

Related U.S. Application Data

(62) Division of application No. 16/863,282, filed on Apr. 30, 2020, now Pat. No. 11,661,665.

(51) Int. Cl.
*C25D 3/44* (2006.01)
*C25D 3/66* (2006.01)
(Continued)

(52) U.S. Cl.
CPC ..... *C25D 3/44* (2013.01); *C25D 3/665* (2013.01); *C25D 5/18* (2013.01); *C25D 5/623* (2020.08);
(Continued)

(58) Field of Classification Search
None
See application file for complete search history.

(56) References Cited

U.S. PATENT DOCUMENTS 2,446,350 A 8/1948 Wier
3,048,497 A * 8/1962 Goran ..... C23C 2/12 205/138
(Continued)

FOREIGN PATENT DOCUMENTS

CN 104499013 A 4/2015
WO 2019163256 A1 8/2019

OTHER PUBLICATIONS

Abbott et al, "Electrodeposition of aluminium and aluminium/platinum alloys from AICI3/benzyltrimethylammonium chloride room temperature ionic liquids," Journal of Applied Electrochemistry 31 (2001) 1345-1350.
(Continued)

*Primary Examiner* — Seth Dumbris
(74) *Attorney, Agent, or Firm* — MH2 Technology Law Group LLP

(57) ABSTRACT

In certain aspects, a coated steel substrate comprises a single or multiple-layer electroplated aluminum coating over a steel substrate. The multiple-layer electroplated aluminum coating comprises one or more porous layers and one or more compact layers. The one or more porous layers comprise a material selected from a group consisting of aluminum and aluminum alloys. The one or more compact layers comprise a material selected from a group consisting of aluminum and aluminum alloys. In certain aspects, a method of depositing a multiple-layer aluminum coating over a steel substrate includes electroplating one or more porous aluminum layers over the steel substrate. The one or more porous aluminum layers comprise a material selected from a group consisting of aluminum and aluminum alloys. One or more compact aluminum layers are electroplated over the steel substrate. The one or more compact aluminum layers com-
(Continued)

prise a material selected from a group consisting of aluminum and aluminum alloys.

20 Claims, 8 Drawing Sheets

(51) Int. Cl.
*C25D 5/00* (2006.01)
*C25D 5/18* (2006.01)
*C25D 7/00* (2006.01)

(52) U.S. Cl.
CPC ..... *C25D 7/00* (2013.01); *Y10T 428/12764* (2015.01)

(56) References Cited

U.S. PATENT DOCUMENTS

| | | | |
|---|---|---|---|
| 3,929,611 | A | 12/1975 | Hess |
| 3,997,410 | A | 12/1976 | Gileadi et al. |
| 4,417,954 | A | 11/1983 | Birkle et al. |
| 4,904,355 | A | 2/1990 | Takahashi |
| 4,966,660 | A | 10/1990 | Setsuko et al. |
| 6,368,467 | B1 | 4/2002 | Andrews et al. |
| 10,106,866 | B2 | 10/2018 | Jeong et al. |
| 10,577,686 | B2 | 3/2020 | Gaydos et al. |
| 10,590,514 | B2 | 3/2020 | Freydina et al. |
| 2005/0272947 | A1 | 12/2005 | Mehler et al. |
| 2006/0110620 | A1* | 5/2006 | Lin ..... C23C 28/021 428/650 |
| 2007/0261966 | A1 | 11/2007 | Fischer |
| 2010/0253543 | A1 | 10/2010 | Szczerba et al. |
| 2011/0253543 | A1 | 10/2011 | Hoshi et al. |
| 2012/0006688 | A1 | 1/2012 | Alemany et al. |
| 2013/0168258 | A1 | 7/2013 | Nakano et al. |
| 2014/0178710 | A1 | 6/2014 | Chen et al. |
| 2014/0272458 | A1 | 9/2014 | Ruan et al. |
| 2015/0101935 | A1 | 4/2015 | Chen |
| 2015/0322582 | A1 | 11/2015 | Freydina et al. |
| 2016/0001338 | A1 | 1/2016 | Koyer et al. |
| 2016/0108533 | A1 | 4/2016 | Dai et al. |
| 2016/0319449 | A1 | 11/2016 | Izagirre Etxeberria et al. |
| 2016/0326607 | A1* | 11/2016 | Jeong ..... C23C 14/28 |
| 2017/0009360 | A1 | 1/2017 | Schuh et al. |
| 2018/0066375 | A1 | 3/2018 | Morgan et al. |
| 2018/0347058 | A1 | 12/2018 | Nulwala et al. |
| 2018/0355470 | A1* | 12/2018 | Gaydos ..... C23C 14/3414 |
| 2019/0074121 | A1 | 3/2019 | Cross et al. |
| 2020/0377973 | A1 | 12/2020 | Okuno et al. |

OTHER PUBLICATIONS

Jiang et al, "Electrodeposition of aluminium from ionic liquids: Part II—studies on the elctrodeposition of aluminum from aluminum chloride (AICI3)—trimethylphenylammonium chloride (TMPAC) ionic liquids," Surface & Coatings Technology 201 (2006) 10-18.

Jiang et al, "Studies on the AICI3/dimethylsulfone (DMSO2) electrolytes for the aluminum deposition processes," Surface & Coatings Technology 201 (2007) 6309-6317.

Caporali et al, "Aluminium electroplated from ionic liquids as protective coating against steel corrosion," Corrosion Science 50 (2008) 534-539.

Liu et al, "Electroplating of mild steel by aluminium in a first generation ionic liquid: A green alternative to commercial AI-plating in organic solvents," Surface & Coatings Technology 201 (2006) 1352-1356. [Abstract Only].

Jiang et al, "Electrodeposition of aluminium from ionic liquids: Part I-electrodeposition and surface morphology of aluminium from aluminium chloride (AICI3)-1-ethyl-3-methylimidazolium chloride ([EMIm]CI) ionic liquids," Surface & Coatings Technology 201 (2006) 1-9.

Ruan et al, "Electrodeposited Al-Mn alloys with microcrystalline, nanocrystalline, amorphous and nano-quasicrystalline structures," Acta Materialia 57 (2009) 3810-3822.

Zhao et al, "Electrodeposition of aluminium from room temperature AICI3-TMPAC molten salts," Electrochimica Acta 42 (1997) 1639-1643. [Abstract Only].

Barchi et al, "Electroplated bright aluminium coatings for anticorrosion and decorative Purposes," Progress in Organic Coatings 68 (2010) 120-125. [Abstract Only].

Matsui et al, "Pre-electrodeposition process for improving tensile ductility of Al electrodeposited from a dimethylsulfone bath." MaterialsLetters 109(2013)229-232 [Abstract Only].

Chen et al, "The electrodeposition of Mn and Zn-Mn alloys from the room-temperature tri-1-butylmethylammonium bis (trifluoromethane)sulfonyl)imide ionic liquid," Electrochimica Acta 52 (2007) 1857-1864. [Abstract Only].

Deng et al, "Electrochemical study and electrodeposition of manganese in the hydrophobic butylmethylpyrrolidinium bis((trifluoromethyl)sulfonyl) imide room-temperature ionic liquid," Electrochimica Acta 53 (2007) 1931-1938. [Abstract Only].

EPA United States, "Health Effects Notebook for Hazardous Air Pollutants," [https://www.epa.gov/haps/health-effects-notebook-hazardous-air-pollutants] Accessed Online Jul. 24, 2019.

Cross Samuel R et al: "Modeling localized corrosion with an effective medium approximation", Corrosion Science, Oxford, GB, vol. 116, Feb. 15, 2017, pp. 53-65 [Abstract Only].

Sipeng Gu et al, "Investigation of Atmospheric Pressure CVD-Produced Aluminum Coatings for the Protection of Steel from Corrosion", Chemical Vapor Deposition, Wiley-VCH Verlag, Weinheim, DE, vol. 16, No. 7-8-9, Dated Sep. 1, 2010 (Sep. 1, 2010), pp. 231-238.

O'Meara M et al: "Deposition of aluminum using ionic liquids: BASF process improves adhesion and coating density", Metal Finishing: Devoted Exclusively to Metallic Surface Treatments, Elsevier, New York, NY, US, vol. 107, No. 7-8, Dated Jul. 1, 2009 (Jul. 1, 2009), pp. 38-39.

European Patent Office, Extended European Search Report for Application 21171147.8 dated Sep. 29, 2021.

Vossen et al., Thin Film Processes (Year: 1978).

"Safety and Health Topics: Cadmium," OSHA: Occupational Safety and Health Administration, Date Accessed: Jul. 24, 2019, pp. 1-3.

* cited by examiner

ALUMINUM AND ALUMINUM ALLOY ELECTROPLATED COATINGS

CROSS-REFERENCE TO RELATED APPLICATIONS

The present disclosure claims benefit of and priority to U.S. application Ser. No. 16/863,282 filed Apr. 30, 2020. The aforementioned patent application is hereby incorporated by reference in its entirety.

FIELD

Aspects generally relate to aluminum and aluminum alloy electroplating compositions, methods of electroplating aluminum and aluminum alloys, and electroplated coatings of aluminum and aluminum alloys.

BACKGROUND

Cadmium coatings are used as a sacrificial coating to protect steel from corrosion. Since cadmium's corrosion potential is more negative than that of steel, cadmium coatings will corrode preferentially to protect steel. Electroplated cadmium coatings have been used extensively as protective coatings for aerospace and military applications. Although cadmium coatings provide excellent technical performance, cadmium coatings are heavily regulated.

Several protective coatings have been developed as alternatives to cadmium. While some of these coatings work well for low-strength carbon steels or low-alloy steels, these coatings are unsuitable for coatings of high-strength steels due to the susceptibility of these steels to hydrogen embrittlement (HE). Aluminum protective coatings are being explored as protective coatings to steel since aluminum's reduction potential is negative to steel. Aluminum coatings deposited by vapor deposition have been explored. However, vapor deposition over large and complex shaped substrates is difficult. Therefore, there is a need for improved methods, compositions, and coatings over steel substrates.

SUMMARY

In certain aspects, a coated steel substrate comprises a multiple-layer electroplated aluminum coating over a steel substrate. The multiple-layer electroplated aluminum coating comprises one or more porous layers and one or more compact layers. The one or more porous layers comprise a material selected from a group consisting of aluminum and aluminum alloys. The one or more compact layers comprise a material selected from a group consisting of aluminum and aluminum alloys.

In certain aspects, a method of depositing a multiple-layer aluminum coating over a steel substrate includes electroplating one or more porous aluminum layers over the steel substrate. The one or more porous aluminum layers comprise a material selected from a group consisting of aluminum and aluminum alloys. One or more compact aluminum layers are electroplated over the steel substrate. The one or more compact aluminum layers comprise a material selected from a group consisting of aluminum and aluminum alloys.

In certain aspects, a coated steel substrate comprises a high strength steel substrate. A multiple-layer electroplated aluminum coating is formed over the high strength steel substrate. The multiple-layer electroplated aluminum coating comprises one or more porous layers and one or more compact layers. The one or more porous layers comprise a material selected from a group consisting of aluminum and aluminum alloys. The one or more compact layers comprise a material selected from a group consisting of aluminum and aluminum alloys. The one or more porous layers have pore sizes of about 2 μm or more. The one or more compact layers have pore sizes of about 0.2 μm or less. Each of the one or more porous layers has a thickness from about 0.3 μm to about 3 μm. Each of the one or more compact layers has a thickness from about 0.3 μm to about 3 μm.

BRIEF DESCRIPTION OF THE DRAWINGS

So that the manner in which the above recited features of the present disclosure can be understood in detail, a more particular description of the disclosure, briefly summarized above, may be had by reference to aspects, some of which are illustrated in the appended drawings. It is to be noted, however, that the appended drawings illustrate only exemplary aspects and are therefore not to be considered limiting of its scope, may admit to other equally effective aspects.

To facilitate understanding, identical reference numerals have been used, where possible, to designate identical elements that are common to the figures. It is contemplated that elements and features of one aspect may be beneficially incorporated in other aspects without further recitation.

DETAILED DESCRIPTION

Figure 1A:
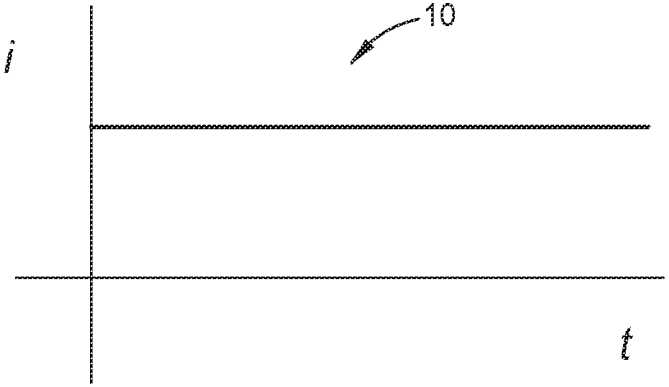
FIG. 1A is a diagram of one example of an electroplating waveform showing direct current applied to a cathode substrate.

Some aspects will now be described in greater detail below, including specific aspects, versions and examples, but the present disclosure is not limited to these aspects, versions or examples, which are included to enable a person having ordinary skill in the art to make and use aspects, when the information in the present disclosure is combined with available information and technology.

Various terms as used herein are defined below. To the extent a term used in a claim is not defined below, it should be given the broadest definition persons in the pertinent art have given that term as reflected in one or more printed publications or issued patents.

All documents described herein are incorporated by reference herein, including any priority documents and/or testing procedures to the extent they are not inconsistent with this text. As is apparent from the foregoing general description and the specific aspects, while forms of the aspects have been illustrated and described, various modifications can be made without departing from the spirit and scope of the present disclosure. Accordingly, it is not intended that the present disclosure be limited thereby. Likewise, the term "comprising" is considered synonymous with the term "including." Likewise whenever a composition, an element or a group of elements is preceded with the transitional phrase "comprising," it is understood that we also contemplate the same composition or group of elements with transitional phrases "consisting essentially of," "consisting of," "selected from the group of consisting of," or "I"" preceding the recitation of the composition, element, or elements and vice versa, e.g., the terms "comprising," "consisting essentially of," "consisting of" also include the product of the combinations of elements listed after the term.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, within a range includes every point or individual value between its end points even though not explicitly recited. Thus, every point or individual value may serve as its own lower or upper limit combined with any other point or individual value or any other lower or upper limit, to recite a range not explicitly recited.

Aluminum and/or aluminum alloy coatings as described herein can provide corrosion resistance and can pass a hydrogen embrittlement (HE) test. HE tests are performed according to ASTM F 519 using Type 1a.1 specimens having a notch. For example, the coatings provide cathodic protection and low hydrogen embrittlement of steel substrates. The aluminum and/or aluminum alloy coatings are applied by an electrodeposition process from an ionic liquid electrolyte plating bath. The aluminum and/or aluminum alloy can be deposited by direct current and/or pulsed current. The aluminum and/or aluminum alloy can be deposited as single layers and/or multiple layers.

The term "aluminum alloy" as used herein means 80% or more aluminum by weight and 20% or less alloying element(s) by weight.

Aluminum and/or aluminum alloy coatings can be deposited on components of aircrafts, spacecrafts, watercrafts, land vehicles, engines, propulsion structure, space re-entry vehicle structures, power-generation turbines, and other metal components. For example, aluminum and/or aluminum alloys can be disposed on one or more surface of aircraft components to form one or more corrosion resistant aluminum and/or aluminum alloy coatings on the aircraft components.

The aluminum and/or aluminum alloy coatings can be applied to steel substrates. The steel substrates can be carbon steels with low-carbon content (lower than 0.2% C), medium-carbon content (between 0.2-0.5% C), or high-carbon content (more than 0.5% C). The steel substrates can be low alloy steels (alloys with not more than 8% of alloying elements) or high-alloy steels (alloys with more than 8% alloying elements). In additional to carbon, other alloying elements include nickel, chromium, and molybdenum to increase strength and toughness. In certain aspects, the steel substrate is a medium-carbon ultra-high strength low-alloy steel (referred herein as "high strength steel") containing between about 0.2 and 0.5% of carbon and not more than 8% of total alloying elements. Examples of high strength steels include structural steels with yield strengths that can exceed 1380 MPa (200 ksi). Examples of high strength steels include steels with AISI/SAE designations of 4130, 4140, 4340, or other designations.

The present aluminum and/or aluminum alloy coatings can be used in place of cadmium or nickel alloy protective coatings. The aluminum and/or aluminum alloy coatings are deposited by electroplating in ionic liquids. Ionic liquids have very low vapor pressures and low flammability and are more environmentally preferred than organic solvents. Ionic liquids are salts in which the ions are poorly coordinated, which results in these salts being liquid below 100° C. Some salts form ionic liquids at room temperature (also known as room temperature ionic liquids (RTILs)). While ordinary liquids are predominantly made of electrically neutral molecules, ionic liquids are largely made of ions and short-lived ion pairs. The ionic liquid can comprise a nitrogen-containing compound, a phosphorous-containing compound, or a sulfur-containing compound.

The nitrogen-containing compound can be selected from a group consisting of aromatic salts, N-alkyl-pyridinium salts, N-alkyl-N'-alkyl' imidazolium salts, N-alkyl-N-alkyl' pyrrolidinium salts, N-alkyl-N-alkyl' piperidinium salts, and other quaternary ammonium salts. Examples of nitrogen-containing compounds of aromatic salts include a quaternary ammonium salt with at least one of the substituents being a phenyl or a quaternary ammonium salt with at least one of the substituents being a benzyl. In certain aspects, the nitrogen-containing compound is a quaternary ammonium salt with at least one of the substituents being a phenyl, such as trimethylphenylammonium salt. In certain aspects, the nitrogen-containing compound is a N-alkyl-N-alkyl' pyrrolidinium cation of formula (I):

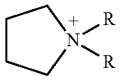

(I)

wherein R and R' independently represent an alkyl group. In certain aspects, R and R' each can represent a C1-C8 alkyl group such as, among others, a methyl, an ethyl, a propyl, a butyl, or an octyl group. In certain aspects, the nitrogen-containing compound is a N-alkyl-N-alkyl' pyrrolidinium salt of 1-butyl-1-methylpyrrolidinium salt. The phosphorous-containing compounds can be suitable quaternary phosphonium salts. The sulfur-containing compounds can be suitable tertiary sulfonium salts.

The counter-anion of any of these salts may be, a sulfonylimide containing anion (such as bis(trifluoromethylsulfonyl)imide), a cyano-containing anion (such as dicyanamide), a sulphur-containing anion (such as methylsulfate), a sulfonate (such as methanesulfonate, tosylate or trifluoromethanesulfonate), a phosphate (such as hexafluorophosphate), a borate (such as tetrafluoroborate), or a halide such as fluoride, chloride, bromide or iodide.

In certain aspects, the ionic liquid may be a nitrogen-containing compound of a phenyl substituted quaternary ammonium halide, such as trimethylphenylammonium chloride (TMPAC). In certain aspects, the ionic liquid may be a nitrogen-containing compound of a N-alkyl-N-alkyl' pyrrolidinium sulfonylimide, such as 1-Butyl-1-methylpyrrolidinium bis(trifluoromethysulfonyl) imide (BMP.TFSI).

An aluminum or aluminum alloy can be deposited by electroplating in an ionic liquid. Examples of alloying elements with aluminum include manganese, zirconium, zinc, other alloying elements, and combinations thereof in which the aluminum alloy comprises 80% or more aluminum by weight and 20% or less alloying element(s) by weight. An electroplating bath include a metal salt of aluminum and a metal salt of the alloying element (if any). The metal salts can be metal halides. For example, an aluminum salt can be an aluminum halide, such as aluminum chloride ($AlCl_3$). For example, a manganese salt can be an anhydrous manganese halide, such as anhydrous manganese chloride ($MnCl_2$). In certain aspects, the counter-anion of the ionic liquid and the counter-anion of metal salt may be the same to improve the solubility of both components.

In certain aspects, an aluminum salt without any other metal salts is provided in the electroplating bath to electroplate a pure aluminum layer. In certain aspects, an aluminum salt and a manganese metal salts are provided in the electroplating bath to electroplate an aluminum-manganese alloy layer. For example, an aluminum salt, such as an aluminum halide, and a manganese salt, such as a manganese halide, can be provided to the electroplating bath in an aluminum salt to manganese salt molar ratio of about 50:1 to about 2:1, such as about 9:1 to 4:1. The composition of the aluminum-manganese alloy can be controlled by the molar ratio of aluminum salt to manganese salt. In certain aspects, the aluminum-manganese alloy layer comprises aluminum from about 80 wt percent to about 90 wt percent and comprises manganese from about 10 wt percent to about 20 wt percent of the total composition of the alloy layer. Manganese increases hardness and enhances corrosion resistance to the aluminum alloy layer in comparison to aluminum alone. Excess of manganese in the aluminum alloy layer can make the layer brittle and can cause the alloy layer to peel off a substrate. Excess of manganese in the aluminum alloy layer can decrease the compatibility of the alloy layer with conversion coatings applied thereon.

The plating bath formulation comprise a mixture of a metal salt and an ionic liquid in a molar ratio from about 2:1 to about 1:1. If the molar ratio is too low, there will be not enough concentration of active metal species to electrodeposit metal to form the metal coating. If the molar ratio is too high, the metal salt may not be soluble within the ionic liquid.

The plating bath may optionality include other additives, such as brightening agents. Examples of brightening agents include organic compounds such as large organic cyclic compounds, bicyclic compounds, monocyclic compounds, acyclic compound, and combinations thereof.

The plating bath formulation is preferably anhydrous and the electroplating is conducted under a dry inert gas stream in order to reduce contact of the electrolyte with ambient moisture. Although absorbed moisture degrades ionic liquids and hinders electroplating, an accurate control of moisture in the electrochemical cell is not a requirement.

In certain aspects, the porosity versus compactness of the deposited aluminum or aluminum alloy coating can be determined by one of more of the following factors: a type of ionic liquid, a mode of electrodeposition (i.e., direct current, bipolar pulsed current, unipolar pulsed current), an alloying element of the coating, and other factors. All of the aluminum or aluminum alloy coatings are receptive to chrome conversion coatings, such as Alodine 1200 (hexavalent Cr) chrome conversions or SurTec 650 (trivalent Cr) chrome conversions.

Open circuit potential (OCP) is used as a criterion for the corrosion behavior of the aluminum or aluminum alloy coating over a substrate, such as a steel substrate. The OCP is a parameter which indicates the thermodynamic tendency of a material to electrochemical oxidation in a corrosive medium. The open circuit potential (OCP) of these aluminum and aluminum alloy coatings over substrates, such as steel substrates, are measured for 14 days in distilled water to indicate sacrificial corrosion protection in neutral water and in 3.5% NaCl solution to indicate sacrificial corrosion protection in salt water. For OCP measurements, electrochemical cells are made with the coated aluminum or aluminum alloy surface as the working electrode and a calomel electrode as the reference electrode. The temperature of the cell during an OCP measurement is maintained at about 30° C. If the OCP of the aluminum or aluminum alloy coating over a substrate is more negative in comparison to a bare substrate, then the aluminum or aluminum alloy coating provides sacrificial corrosion protection to the substrate.

In certain aspects, the aluminum and/or aluminum coatings can be electroplated on a cathode substrate, such as a steel substrate, by direct current applied to the cathode substrate. FIG. 1A is a diagram of one example of an electroplating waveform 10 showing direct current applied to a cathode substrate. For example, a current density from about 1 $mA/cm^2$ to about 100 $mA/cm^2$, such as from 5 $mA/cm^2$ to about 25 $mA/cm^2$, can be applied to a cathode substrate. The current density to the cathode substrate is the amount of current per exposed surface area of the cathode substrate within the plating bath.

In certain aspects, electroplating an aluminum or aluminum alloy layer by direct current in an ionic liquid of a quaternary ammonium salt with at least one of the substituents being a phenyl, such as TMPAC, forms a compact aluminum or aluminum alloy layer. The term "compact' layer as used herein is a layer having pore sizes of about 0.2 μm or less. A compact layer can provide barrier protection by slowing down ingress of corrosive ions and other species to the underlying substrate. A compact layer can provide corrosion sacrificial protection. In certain aspects, electroplating an aluminum or aluminum alloy layer by direct current in an ionic liquid of a quaternary ammonium salt with at least one of the substituents being a phenyl provides cathodic protection in salt water and in neutral water as determined by OCP.

In certain aspects, electroplating an aluminum or aluminum alloy by direct current in an ionic liquid of an a-alkyl-N-alkyl' pyrrolidinium sulfonylimide, such a (BMP.TFSI), forms a porous aluminum or aluminum alloy layer having pore sizes of about 2 μm or more. In certain aspects, electroplating an aluminum or aluminum alloy by direct current in an ionic liquid of an a-alkyl-N-alkyl' pyrrolidinium sulfonylimide provides cathodic protection in salt water but not in neutral water as determined by OCP. These aluminum coatings after chromium conversion have a salt spray testing lifetime (ASTM B 117) of over 500 hrs without formation of red rust.

In certain aspects, electroplating an aluminum-manganese alloy by direct current in any suitable ionic liquid forms a compact aluminum-manganese layer having pore sizes of about 0.2 μm or less. In certain aspects, electroplating an aluminum-manganese alloy by direct current in any suitable ionic liquid provides cathodic protection in salt water and in neutral water as determined by OCP.

Figure 1B:
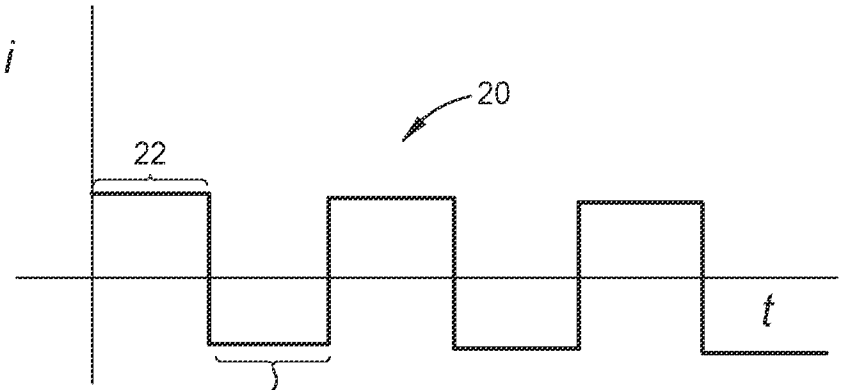
FIG. 1B is a diagram of one example of an electroplating waveform showing bipolar pulses applied to a cathode substrate.

In certain aspects, the aluminum and/or aluminum coatings can be electroplated by bipolar pulsed current to a cathode substrate. FIG. 1B is a diagram of one example of an electroplating waveform 20 showing bipolar pulses applied to a cathode substrate. In the example of FIG. 1B, bipolar pulsed current comprises a plurality of deposition pulses 22 and plurality of etching pulses 24. In certain aspects, each of the deposition pulses 22 has a duration from about 100 ms to about 1,000 ms, and each of etching pulses 24 has a duration from about 100 ms to about 1,000 ms. In certain aspects, a current density of each of the deposition pulses 22 is from about 5 mA/cm$^2$ to about 25 mA/cm$^2$, and a current density of each of the etching pulses 24 is from about 0.5 mA/cm$^2$ to about 5 mA/cm$^2$. In certain aspects, electroplating an aluminum or aluminum alloy layer by bipolar pulsed current forms a compact aluminum or aluminum alloy layer having pore sizes of about 0.2 μm or less. In certain aspects, electroplating an aluminum or aluminum alloy layer by bipolar pulsed current provides cathodic protection in salt water and in neutral water as determined by OCP. These aluminum coatings after chromium conversion have a salt spray testing lifetime (ASTM B 117) of over 1,000 hrs without formation of red rust.

Figure 1C:
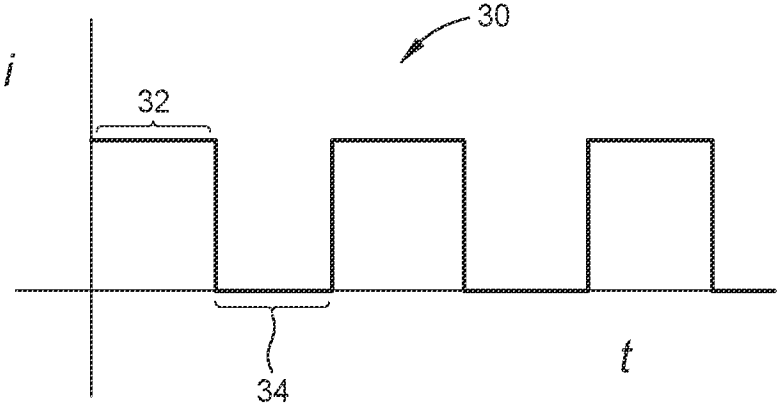
FIG. 1C is a diagram of one example of an electroplating waveform showing unipolar pulses applied to the cathode substrate.

In certain aspects, the aluminum and/or aluminum coatings can be electroplated by unipolar pulsed current to a cathode substrate. FIG. 1C is a diagram of one example of an electroplating waveform 30 showing unipolar pulses applied to a cathode substrate. In the example of FIG. 1C, unipolar pulsed current comprises a plurality of ON pulses 32 and plurality of OFF pulses 34. In certain aspects, each ON pulse has a duration from about 100 ms to about 500 ms, and each OFF pulse having a duration from about 100 ms to about 500 ms. In certain aspects, the current density of the ON pulses 32 is from about 5 mA/cm$^2$ to about mA/cm$^2$. In certain aspects, electroplating an aluminum or aluminum alloy layer by unipolar pulsed current forms a compact aluminum or aluminum alloy layer having pore sizes of about 0.2 μm or less. In certain aspects, electroplating an aluminum or aluminum alloy layer by bipolar pulsed current provides cathodic protection in salt water and in neutral water as determined by OCP. In certain aspects, unipolar pulsed current avoids undesirable passivation of the aluminum anode of the electroplating system. Undesirable passivation of the aluminum anode may occur during etching or reverse-plating of the cathode substrate which causes electroplating of aluminum onto the anode. Freshly deposited aluminum over the anode may hinder dissolution of the anode in the forward pulse or deposition pulse. These aluminum coatings after chromium conversion have a salt spray testing lifetime (ASTM B 117) of over 1,000 hrs without formation of red rust.

Figure 1D:
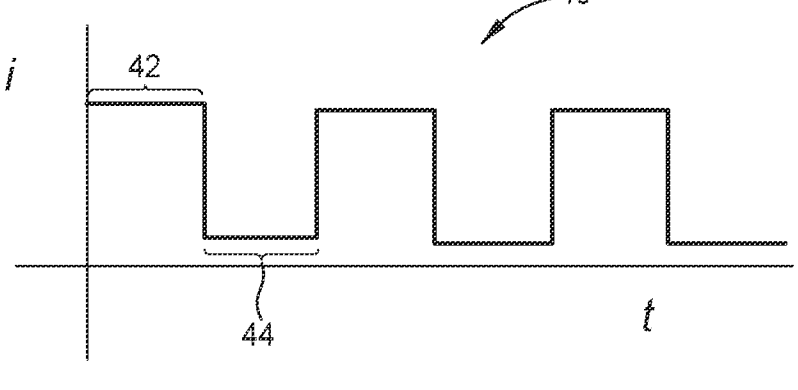
FIG. 1D is a diagram of another example of an electroplating waveform showing unipolar pulses applied to the cathode substrate.

FIG. 1D is a diagram of another example of an electroplating waveform showing unipolar pulses applied to the cathode substrate. As shown in FIG. 1D, the aluminum and/or aluminum coatings can be electroplated by unipolar pulsed current to a cathode substrate with a plurality of high current pulses 42 and a plurality of low current pulses 44. For example, high current pulses 42 can be deposition pulses applied to the cathode substrate with a current density of about mA/cm$^2$ or more and low current pulses 44 can be deposition pulses applied to the cathode substrate with a current density greater than zero and less than 5 mA/cm$^2$.

The pulsed current to the cathode substrate are shown in FIGS. 1B-C as rectangular waveforms. In other aspects, the pulsed current can also be other waveforms, such as saw-tooth waveforms, sinusoidal waveform, curved waveforms, trapezoidal waveforms, and triangular waveforms.

Figure 2:
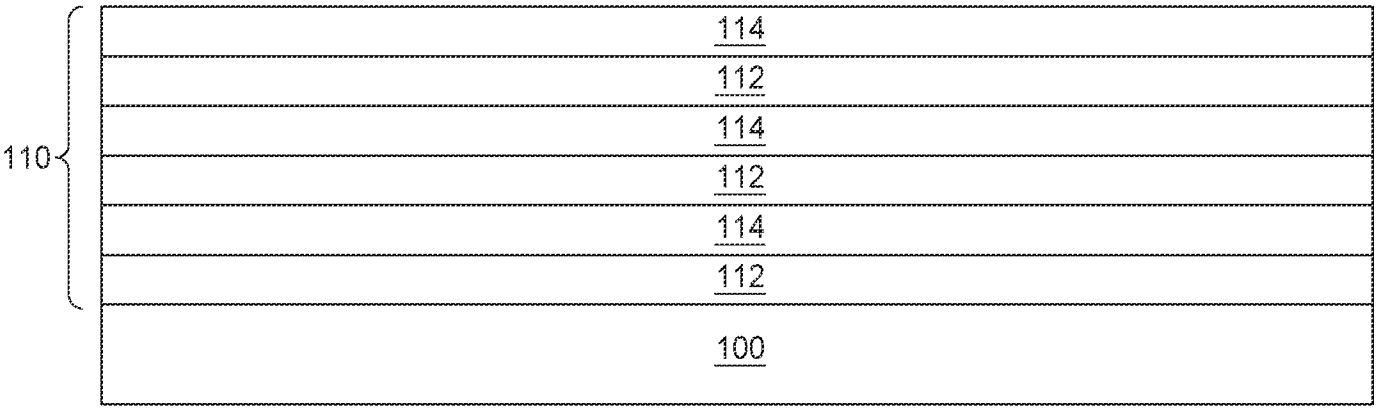
FIG. 2 is a schematic cross-section view of one example of a multiple-layered aluminum coating over a substrate

FIG. 2 is a schematic cross-section view of one example of a multiple layer aluminum coating 110 over a substrate 100, such as a steel substrate. The multiple layer aluminum coating 110 comprises one or more porous layers 112 and one or more compact layers 114. The one or more porous layers 112 comprise aluminum or an aluminum alloy. The one or more compact layers 114 comprise aluminum or an aluminum alloy. Each of the one or more porous layers 112 can have a thickness from about 0.3 μm to about 3 μm. Each of the one or more compact layers 114 can have a thickness from about 0.3 μm to about 3 μm. A porous layer 112 or a compact layer 114 having a thickness of less than 0.3 μm may be undesirably discontinuous. A porous layer 112 having a thickness of over 3 μm may reduce the overall strength of the multiple layer aluminum coating 110. A compact layer 114 having a thickness of over 3 μm may hinder the escape of trapped hydrogen gas and may cause hydrogen embrittlement of the underlying substrate. In certain aspects, the multiple layer aluminum coating 110 has a total thickness from about 10 μm to about 40 μm and provides sacrificial corrosion protection.

In certain aspects, electroplating a multiple-layer aluminum coating with one or more porous layers and one or more compact layers provides cathodic protection in salt water and in neutral water. These coatings after chromium conversion have a salt spray testing lifetime (ASTM B 117) of over 1,000 hrs, such as over 1,500 hrs, without formation of red rust. Not wishing to be bound by theory unless specifically set forth in the claims, it is believed that the one or porous layers 112 of the multiple layer aluminum coating 110 help to release gases, like hydrogen, trapped during electroplating. The one or more compact layers 114 of the multiple layer aluminum coating 110 help to provide cathodic protection in salt water and in neutral water. The release of trapped gases reduces hydrogen embrittlement of the underlying substrate while increases the salt spray corrosion of the multiple-layer aluminum coating.

The presents aluminum and aluminum coatings each passes a hydrogen embrittlement (HE) test. HE tests are performed according to ASTM F 519 using Type 1a.1 specimens having a notch. For HE testing, a load is applied to a notch on a high strength steel 4340 specimen (Type 1a.1) without any coating to determine an average notch fracture strength (NFS) value based from three uncoated samples. The average NFS for the high strength steel 4340 sample is determined to be 3,953 Kg. The aluminum or aluminum alloy coated specimens were loaded to 75% of NFS and held at this load for 200 hours. The aluminum or aluminum alloy coated specimens passes HE tests if no fracturing is observed.

One or more porous layers 112 and one or more compact layer 114 provide a multiple layer aluminum coating 110 with corrosion resistance provide to a steel substrate in salt water and in neutral water as determined by OCP. The electroplating process to form the multiple-layer electroplated aluminum coating 110 utilizes environmentally preferred compositions and processes.

Aspects

The present disclosure provides, among others, the following aspects, each of which may be considered as optionally including any alternate aspects.

Clause 1. A coated steel substrate comprising a steel substrate and a multiple-layer electroplated aluminum coating over the steel substrate. The multiple-layer electroplated aluminum coating comprises at least one porous layer and at least one compact layer. The at least one porous layer comprises a material selected from a group consisting of aluminum and aluminum alloys. The at least one compact layer comprises a material selected from a group consisting of aluminum and aluminum alloys.

Clause 2. The coated steel substrate of any of the clauses 1 or 3-7, wherein the at least one porous layer has a plurality of pores having a pore size of about 2 μm or more and wherein the at least one compact layer has a plurality of pores having a pore size of about 0.2 μm or less.

Clause 3. The coated steel substrate of any of the clauses 1-2 or 4-7, wherein the at least one porous layer has a thickness from about 0.3 μm to about 3 μm and the at least one compact layer has a thickness from about 0.3 μm to about 3 μm.

Clause 4. The coated steel substrate of any of the clauses 1-3 or 5-7, wherein the multiple-layer electroplated aluminum coating comprises from one to fifty porous layers and from one to fifty compact layers.

Clause 5. The coated steel substrate of any of the clauses 1-4 or 6-7, wherein the multiple-layer electroplated aluminum coating is configured to provide sacrificial corrosion protection of over 1,000 hrs under ASTM B 117.

Clause 6. The coated steel substrate of any of the clauses 1-5 or 7, wherein the multiple-layer electroplated aluminum coating passes a hydrogen embrittlement (HE) test performed according to ASTM F 519 using Type 1a.1 specimens having a notch.

Clause 7. The coated steel substrate of any of the clauses 1-6, wherein the multiple-layer electroplated aluminum coating provides sacrificial corrosion protection to the steel substrate in neutral water and in salt water.

Clause 8. A method of depositing a multiple-layer aluminum coating over a steel substrate comprising electroplating one or more porous aluminum coatings over the steel substrate. The one or more porous aluminum layers comprise a material selected from a group consisting of aluminum and aluminum alloys. One or more compact aluminum layers are electroplated over the steel substrate. The one or more compact aluminum layers comprise a material selected from a group consisting of aluminum and aluminum alloys.

Clause 9. The method of any of the clauses 8 or 10-16, wherein the one or more compact aluminum layers are electroplated utilizing a direct current.

Clause 10. The method of any of the clauses 8-9 or 11-16, wherein the one or more compact aluminum layers are electroplated utilizing a pulsed current.

Clause 11. The method of any of the clauses 8-10 or 13-16, wherein the pulsed current is a unipolar pulsed current comprising a plurality of ON pulses and a plurality of OFF pulses, each of the plurality of ON pulses having a current density from about 5 $mA/cm^2$ to about 25 $mA/cm^2$, each of the plurality of ON pulses having a duration from about 100 ms to about 500 ms, and each of the plurality of OFF pulses having a duration from about 100 ms to about 500 ms.

Clause 12. The method of any of the clauses 8-10 or 13-16, wherein the pulsed current is a bipolar pulsed current comprising a plurality of deposition pulses and a plurality of etching pulses, each of the plurality of deposition pulses having a current density from about 5 $mA/cm^2$ to about 25 $mA/cm^2$, each of the plurality of etching pulses having a current density from about 0.5 $mA/cm^2$ to about 5 $mA/cm^2$, each of the plurality of deposition pulses having a duration from about 100 ms to about 1,000 ms, and each of the plurality of etching pulses having a duration from about 100 ms to about 1,000 ms.

Clause 13. The method of any of the clauses 8-12 or 14-16, wherein the one or more compact aluminum layers comprise an aluminum-manganese alloy electroplated in an electroplating bath including an aluminum salt and a manganese salt.

Clause 14. The method of clause 13, wherein the electroplating bath includes the aluminum salt and the manganese salt in a molar ratio from about 9:1 to about 4:1.

Clause 15. The method of clause 13, wherein the aluminum-manganese alloy comprises aluminum from about 80 weight percent to about 90 weight percent and manganese from about 10 weight percent to about 20 weight percent.

Clause 16. The method of any of the clauses 8-15, wherein the one or more porous aluminum layers are electroplated in an ionic liquid of an a-alkyl-N-alkyl' pyrrolidinium sulfonylimide utilizing a direct current.

Clause 17. A coated steel substrate comprising a high strength steel substrate and a multiple-layer electroplated aluminum coating over the steel substrate. The multiple-layer electroplated aluminum coating comprises at least one porous layer and at least one compact layer. The at least one porous layer comprises a material selected from a group consisting of aluminum and aluminum alloys. The at least one compact layer comprises a material selected from a group consisting of aluminum and aluminum alloys. The at least one porous layer has a plurality of pores having a pore size of about 2 μm or more. The at least one compact layer has a plurality of pores having a pore size of about 0.2 μm or less. The at least one porous layer has a thickness from about 0.3 μm to about 3 μm. The at least one compact layer has a thickness from about 0.3 μm to about 3 μm.

Clause 18. The coated steel substrate of any of the clauses 17 or 19-21, wherein the multiple-layer electroplated aluminum coating is configured to provide sacrificial corrosion protection of over 1,000 hrs under ASTM B 117.

Clause 19. The coated steel substrate of any of the clauses 17-18 or wherein the multiple-layer electroplated aluminum coating passes a hydrogen embrittlement (HE) test performed according to ASTM F 519 using Type 1a.1 specimens having a notch.

Clause 20. The coated steel substrate of any of the clauses 17-19 or 21, wherein the at least one porous layer is electroplated by direct current and wherein the at least one compact layer is electroplated by pulsed current, wherein the multiple-layer electroplated aluminum coating is configured to provide corrosion resistance to the steel substrate in neutral water and in salt water.

Clause 21. The coated steel substrate of any of the clauses 17-20, wherein the multiple layer aluminum coating has a thickness from about 10 μm to about 40 μm and provides sacrificial corrosion protection.

Clause 22. A method of depositing an aluminum layer or aluminum alloy layer over a steel substrate, comprising disposing a surface of the steel substrate in a plating bath. The plating bath comprises an ionic liquid and a metal salt of aluminum. Aluminum is electroplated over the steel substrate to form a compact layer. The compact layer having a plurality of pores having a pore size of about 0.2 μm or less.

Clause 23. The method of any of the clauses 22 or 27-28, wherein aluminum is electroplated utilizing a unipolar pulsed current comprising a plurality of ON pulses and a plurality of OFF pulses, each of the plurality of ON pulses having a current density from about 5 mA/cm$^2$ to about 25 mA/cm$^2$, each of the plurality of ON pulses having a duration from about 100 ms to about 500 ms, and each of the plurality of OFF pulses having a duration from about 100 ms to about 500 ms Clause 24. The method of any of the clauses 22 or 27-28, wherein aluminum is electroplated utilizing a bipolar pulsed current comprising a plurality of deposition pulses and a plurality of etching pulses, each of the plurality of deposition pulses having a current density from about 5 mA/cm$^2$ to about 25 mA/cm$^2$, each of the plurality of etching pulses having a current density from about 0.5 mA/cm$^2$ to about 5 mA/cm$^2$, each of the plurality of deposition pulses having a duration from about 100 ms to about 1,000 ms, and each of the plurality of etching pulses having a duration from about 100 ms to about 1,000 ms.

Clause 25. The method of any of the clauses 22 or 27-28, wherein the plating bath further includes a manganese salt, and wherein an aluminum-manganese alloy is electroplated to form the compact layer.

Clause 26. The method of clause 25, wherein the aluminum-manganese alloy comprises aluminum from about 80 weight percent to about 90 weight percent and manganese from about 10 weight percent to about 20 weight percent.

Clause 27. The method of any of the clauses 22-26 or 28, wherein the compact layer has a thickness from about 0.3 μm to about 3 μm.

Clause 28. The method of any of the clauses 22-27, wherein the compact layer provides sacrificial corrosion protection to the steel substrate.

Clause 29. A method of depositing an aluminum layer or aluminum alloy layer over a steel substrate, comprising disposing a surface of the steel substrate in a plating bath. The plating bath comprises an ionic liquid and a metal salt of aluminum. Aluminum is electroplated over the steel substrate to form a porous layer. The porous layer having a plurality of pores having a pore size of about 2 μm or more.

Clause 30. The method of any of the clauses 29 or 31-33, and wherein aluminum is electroplated utilizing a direct current.

Clause 31. The method of any of the clauses 29-30 or 32-33, wherein the porous layer has a thickness from about 0.3 μm to about 3 μm.

Clause 32. The method of any of the clauses 29-31 or 33, further comprising releasing hydrogen gas through the pores of the porous layer during electroplating, and wherein the coated steel substrate passes a hydrogen embrittlement (HE) test performed according to ASTM F 519 using Type 1a.1 specimens having a notch.

Clause 33. The method of any of the clauses 29-32, wherein the porous layer provides sacrificial corrosion protection to the steel substrate.

Clause 34. A method of depositing a multiple-layer aluminum or aluminum alloy coating over a steel substrate comprising disposing a surface of the steel substrate in a plating bath. The plating bath comprises an ionic liquid and a metal salt of aluminum. The multiple-layer aluminum or aluminum alloy coating is deposited over the surface of the steel substrate. One or more aluminum or aluminum alloy layers of the multiple-layer aluminum or aluminum alloy coating are electroplated by utilizing direct current. One or more aluminum or aluminum alloy layers of the multiple-layer aluminum or aluminum alloy coating are electroplated by utilizing pulsed current.

Clause 35. The method of any of the clauses 34 or 36-39, wherein the pulsed current is a unipolar pulsed current comprising a plurality of ON pulses and a plurality of OFF pulses, each of the ON pulses having a current density from about 5 mA/cm$^2$ to about 25 mA/cm$^2$, each of the ON pulses having a duration from about 100 ms to about 500 ms, and each of the OFF pulses having a duration from about 100 ms to about 500 ms.

Clause 36. The method of any of the clauses 34-35 or 37-39, wherein the pulsed current is a bipolar pulsed current comprising a plurality of deposition pulses and a plurality of etching pulses, each of the deposition pulses having a current density from about 5 mA/cm$^2$ to about 25 mA/cm$^2$, each of the etching pulses having a current density from about 0.5 mA/cm$^2$ to about 5 mA/cm$^2$, each of the deposition pulses having a duration from about 100 ms to about 1,000 ms, and each of the etching pulses having a duration from about 100 ms to about 1,000 ms.

Clause 37. The method of any of the clauses 34-36 or 38-39, wherein the direct current is applied at a current density from about 5 mA/cm$^2$ to about 20 mA/cm$^2$.

Clause 38. The method of any of the clauses 34-37 or 39, wherein the ionic liquid comprises an a-alkyl-N-alkyl' pyrrolidinium sulfonylimide.

Clause 39. The method of any of the clauses 34-38, wherein the plating bath further comprises a manganese salt and the plating bath includes the aluminum salt and the manganese salt in a molar ratio from about 9:1 to about 4:1.

EXAMPLE

Electrodeposition processes were carried out on sand blasted steel coupons by applying direct current electroplating and pulsed current electroplating.

Example 1

Anhydrous aluminum chloride was dissolved in trimethylphenylammonium chloride (TMPAC) at 60° C. to create the electrolytic solution. The concentration of ionic liquid (TMPAC) was kept at 30-35 mol % to which 65-70 mol % of anhydrous $AlCl_3$ was added to prepare the solution. Mixing of the above two chemicals was carried out under argon purging. The coatings were deposited in closed cell under continuous supply of argon gas to restrict the entry of air or moisture in the bath. Electrodeposition of aluminum was carried out at 60° C. with 4-8 mA/cm$^2$ applied current density over steel coupons used as the cathodes with a pure aluminum sheet used as the anode. The deposited plate was cleaned with alcohol and left for drying.

Figure 3B:
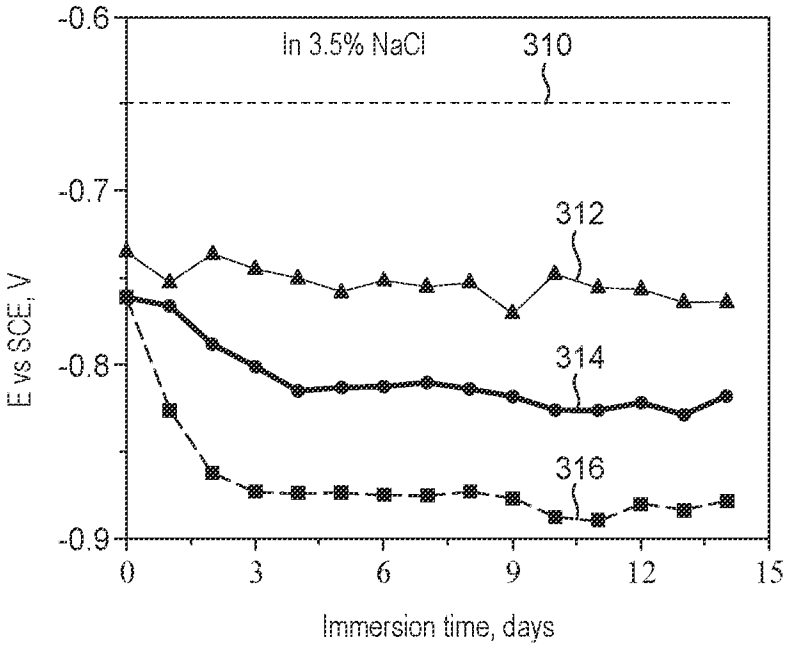
FIGS. 3A-B are graphs of OCP measurements of an aluminum coating on high strength steel substrates in distilled water and in a NaCl solution.
Figure 3A:
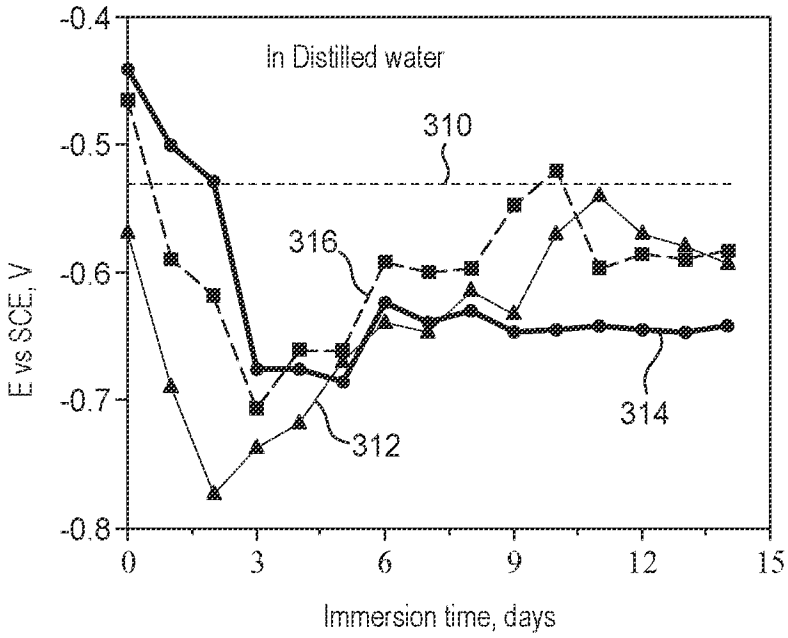

FIGS. 3A-B are graphs of OCP measurements of the aluminum coating on high strength steel 4130 substrates in distilled water (FIG. 3A) and in 3.5% NaCl solution (FIG. 3B). Line 310 represents the rest potential of the bare steel substrate. Lines 312, 314, 316 represent three steel substrates with the aluminum coating. As shown in FIG. 3A, the aluminum coatings provide some sacrificial protection to the steel substrate in distilled water since the coatings generally had more negative OCP values compared to the bare steel substrate. As shown in FIG. 3B, the aluminum coatings provided sacrificial protection to the steel substrate in salt water since the coatings had more negative OCP values compared to the bare steel substrate.

Example 2

36 g of anhydrous aluminum chloride was dissolved in 100 ml of ionic liquid '1-Butyl-1-methylpyrrolidinium bis (trifluoromethysulfonyl)imide' (BMP.TFSI) and the clear solution was obtained by heating at 100° C. Aluminum electrodeposition was carried out in closed cell under continuous supply of argon gas to restrict the entry of air or moisture in the bath at 100° C. at 8-12 mA/cm$^2$ applied current density. This ionic liquid is more stable in air and moisture. The anodes were placed at both sides of cathode to get uniform deposition.

Figure 4B:
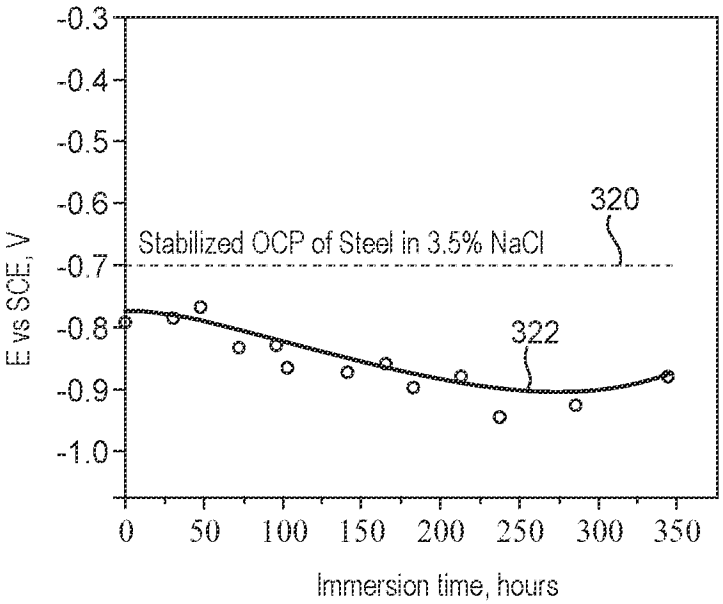
FIGS. 4A-B are graphs of OCP measurements of an aluminum coating on high strength steel substrates in distilled water and in a NaCl solution.
Figure 4A:
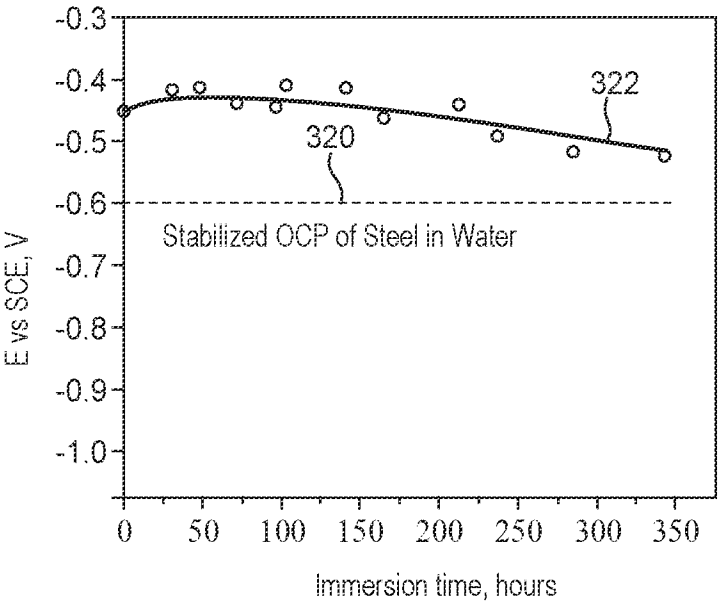

(a) Direct Current: The coatings were deposited using direct current with a current density of at 8 mA/cm$^2$. A deposition time of about 2 hours gave aluminum coatings of thickness about 30 μm. Samples of the aluminum plated steel substrates with a chrome conversion coating (utilizing Alodine 1200) were subjected to a salt spray test. The samples passed for over 550 hrs without signs of red rusts. Rusting began about 600 hrs. FIGS. 4A-B are graphs of OCP measurements of the aluminum coating on high strength steel 4130 substrates in distilled water (FIG. 4A) and in 3.5% NaCl solution (FIG. 4B). Line 320 represents the rest potential of the bare steel substrate. Line 322 represents a steel substrates with the aluminum coating. As shown in FIG. 4A, the aluminum coating did not provide sacrificial protection to the steel substrate in distilled water since the coating had a more positive OCP values compared to the bare steel substrate. As shown in FIG. 4B, the aluminum coating provides sacrificial protection to the steel substrate in salt water since the coating had a more negative OCP values compared to the bare steel substrate. A SEM image of the aluminum coating shows that the coating has high porosity with pore sizes of about 10 μm. It is believed that distilled water can penetrate the pores of the aluminum coating shifting the OCP of the coating.

Figure 5:
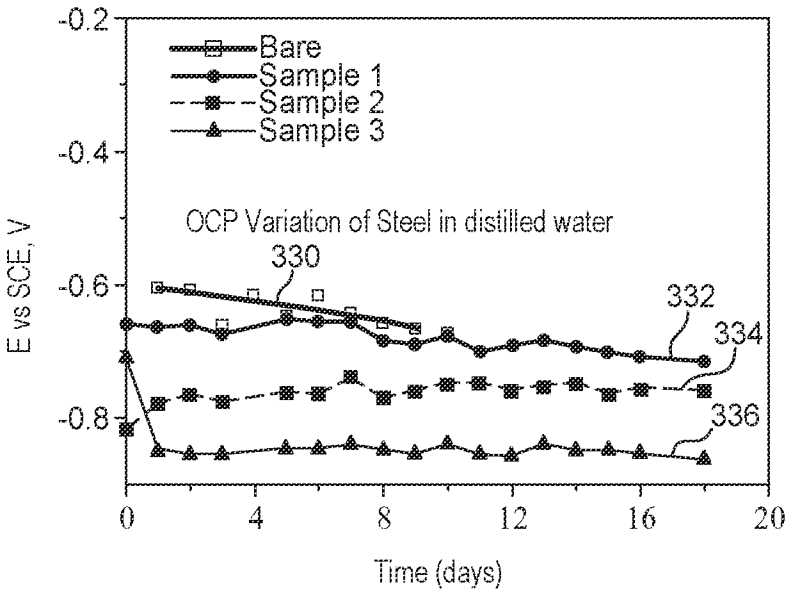
FIG. 5 is a graph of OCP measurements of an aluminum coating on high strength steel substrates in distilled water.

(b) Bipolar pulse current: The coatings were deposited at 10 mA/cm$^2$ for 500 ms and the polarity was reversed for 500 ms for dissolution to take place at cathode at a current density of 1 mA/cm$^2$. For a plating time of about 3 hours the thickness of aluminum coating was about 24 μm. Samples of the aluminum coated steel substrates with a chrome conversion (utilizing an Alodine 1200, containing hexavalent Cr) were subjected to a salt spray test. The samples passed for over 1,000 hrs without signs of red rusts. FIG. 5 is a graph of OCP measurements of the aluminum coatings on high strength steel 4130 substrates in distilled water. Line 330 represents the rest potential of the bare steel substrate. Lines 332, 334, 336 represent three steel substrates with the aluminum coatings. The aluminum coatings provided sacrificial protection to the steel substrate in distilled water since the coating had a more negative OCP values compared to the bare steel substrate. A SEM image of the aluminum coating shows that the aluminum coating has low porosity with pore sizes of about 0.2 μm or less.

Figure 6B:
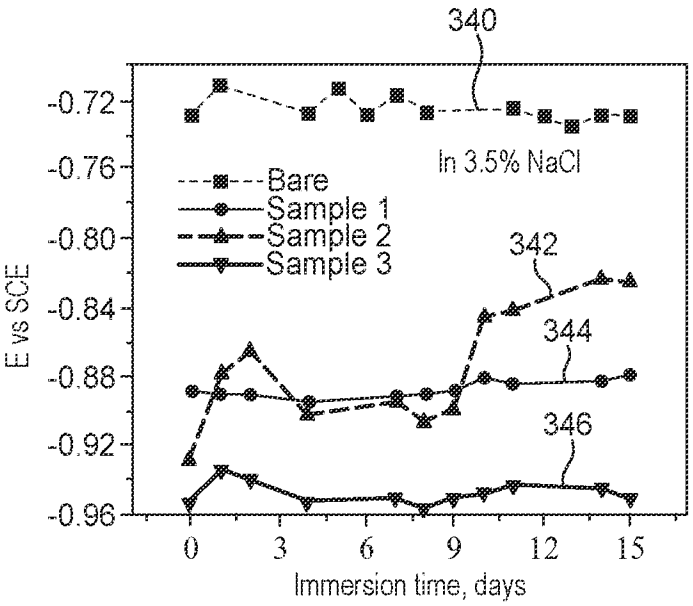
FIGS. 6A-B are graphs of OCP measurements of an aluminum coating on high strength steel substrates in distilled water and in a NaCl solution.
Figure 6A:
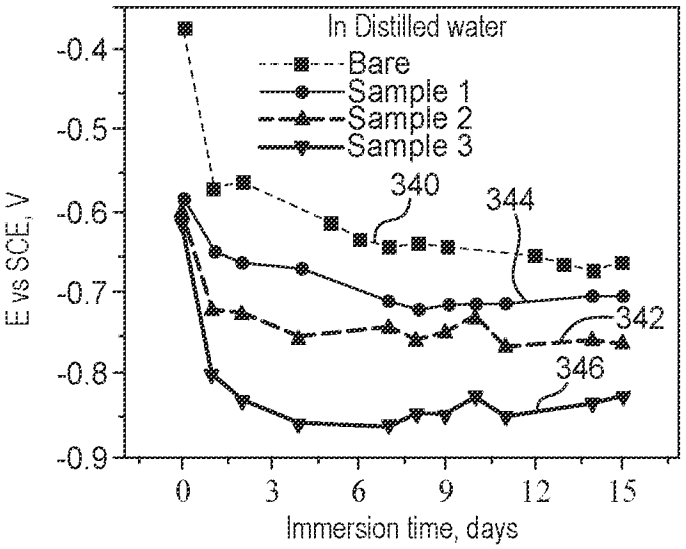

(c) Unipolar pulse current ($t_{on}$ and $t_{off}$ mode): The coatings were deposited in unipolar pulse current mode at 12 mA/cm$^2$ current density using $t_{on}=t_{off}=250$ ms. For a plating time of about 2 hours the thickness of aluminum coating was about 24 μm. Samples of the aluminum coated steel substrates chrome conversion coated with Surtec 650 (containing trivalent Cr) and were subjected to a salt spray test. The samples passed for over 1,000 hrs without signs of red rusts. FIGS. 6A-B are graphs of OCP measurements of the aluminum coating on high strength steel 4130 substrates in distilled water (FIG. 6A) and in 3.5% NaCl solution (FIG. 6B). Line 340 represents the rest potential of the bare steel substrate. Lines 342, 344, 346 represent three steel substrates with the aluminum coating. As shown in FIG. 6A, the aluminum coatings provide sacrificial protection to the steel substrate in distilled water since the coatings had more negative OCP values compared to the bare steel substrate. As shown in FIG. 6B, the aluminum coatings provided sacrificial protection to the steel substrate in salt water since the coatings had more negative OCP values compared to the bare steel substrate.

(d) Layer by layer using direct current and unipolar pulse current alternatively to form a multiple-layer aluminum coating. For a plating time of about 2 hours the thickness of aluminum coating was about 25 μm. The aluminum coated steel substrates with a chrome conversion (Surtec 650) were subjected to a salt spray test. The samples passed for over 1,000 hrs without signs of red rust.

Figure 7B:
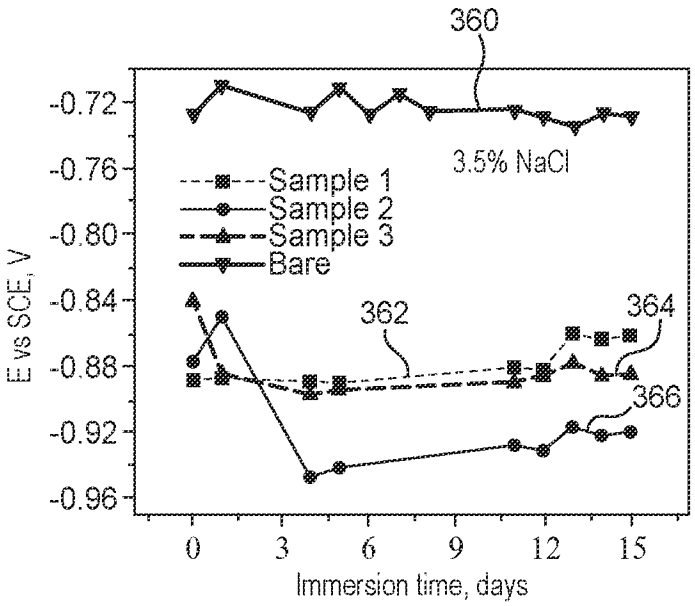
FIGS. 7A-B are graphs of OCP measurements of a multiple-layer aluminum coating on high strength steel substrates in distilled water and in a NaCl solution.
Figure 7A:
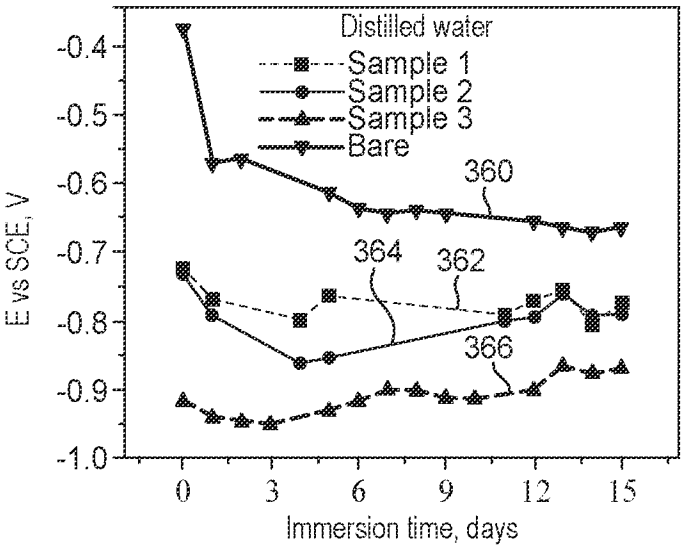

FIGS. 7A-B are graphs of OCP measurements of the multiple-layer aluminum coatings on high strength steel 4130 substrates in distilled water (FIG. 7A) and in 3.5% NaCl solution (FIG. 7B). Line 360 represents the rest potential of the bare steel substrate. Lines 362, 364, 366 represent three steel substrates with the multiple-layer aluminum coating. As shown in FIG. 7A, the multiple-layer aluminum coatings provided sacrificial protection to the steel substrate in distilled water since the coatings had more negative OCP values compared to the bare steel substrate. As shown in FIG. 7B, the multiple-layer aluminum coatings provided sacrificial protection to the steel substrate in salt water since the coatings had more negative OCP values compared to the bare steel substrate.

Example 3

45 g of anhydrous aluminum chloride was dissolved in 125 ml of ionic liquid of 1-Butyl-1-methylpyrrolidinium bis(trifluoromethysulfonyl)imide and the clear solution was obtained by heating at 100° C. After complete dissolution of aluminum chloride (transparent honey color solution) anhydrous manganese chloride (0.08-0.1 M) was added to the solution. After the addition of anhydrous manganese chloride, 25 ml of n-decane was added in the cell to prevent the entry of moisture in the cell as manganese chloride dissolves slowly. Also, the addition of n-decane prevents the blackening of the coating due to moisture. Stirring of solution continued for 1 hour. Al—Mn electrodeposition was carried out in closed cell under continuous supply of Ar gas to restrict the entry of air or moisture in the bath at 100° C. at 8-12 mA/cm$^2$ applied current density as in the case of pure Al electrodeposition. This ionic liquid is more stable in air and moisture. The anodes were placed at both sides of the cathode to get uniform deposition. The electrodeposition was carried out on the steel coupons for 2 hours. After completion of the deposition experiment, the cathode was wiped with cotton soaked in $CH_2Cl_2$.

Figure 8B:
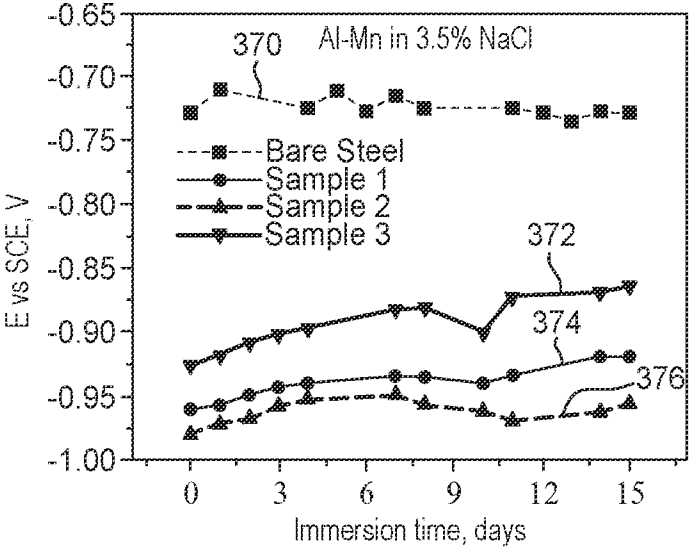
FIGS. 8A-B are graphs of OCP measurements of an aluminum-manganese alloy coating on high strength steel substrates in distilled water and in a NaCl solution.
Figure 8A:
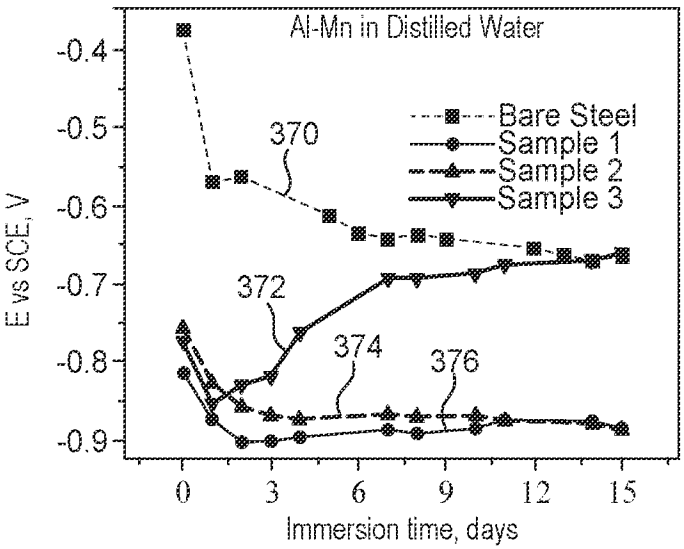

FIGS. 8A-B are graphs of OCP measurements of Al—Mn (85 weight percent Al, 15 weight percent Mn) coating on high strength steel 4130 substrates in distilled water (FIG. 8A) and in 3.5% NaCl solution (FIG. 8B). Line 370 represents the rest potential of the bare steel substrate. Lines 372, 374, 376 represent three steel substrates with an Al—Mn coating. As shown in FIG. 8A, the Al—Mn coatings provide some sacrificial protection to the steel substrate in distilled water since the coatings generally had more negative OCP values compared to the bare steel substrate. As shown in FIG. 8B, the Al—Mn coatings provided sacrificial protection to the steel substrate in salt water since the coatings had more negative OCP values compared to the bare steel substrate.

Example 4

Hydrogen Embrittlement (HE) tests were done according to ASTM F 519 using Type 1a.1 test specimens. Aluminum and aluminum alloys were deposited on the middle portion of the bar including the notch area. The samples were baked at 190° C. for 24 hrs before testing. Prior to HE testing of coated samples, the uncoated samples were tested for 200 hrs and no failure was observed. Average notch fracture strength (NFS) value based from three uncoated samples was determined to be 3953 Kg. The Al and Al alloy coated specimens were loaded to 75% NFS and held at this load for 200 hours. No fracturing was observed, indicating that these coatings pass the HE test.

While the foregoing is directed to aspects of the present disclosure, other and further aspects of the disclosure may be devised without departing from the basic scope thereof, and the scope thereof is determined by the claims that follow.

What is claimed is:

1. A coated steel substrate, comprising:

a steel substrate; and a multiple-layer electroplated aluminum coating over the steel substrate, the multiple-layer electroplated aluminum coating comprising, a porous layer disposed on the steel substrate, the porous layer comprising a material selected from the group consisting of aluminum and aluminum alloy, wherein the porous layer has a plurality of pores having a pore size of about 2 μm or more, and a compact layer disposed on the porous layer, the compact layer comprising a material selected from the group consisting of aluminum and aluminum alloy, wherein the compact layer comprises a plurality of pores having a pore size of about 0.2 μm or less.

2. The coated steel substrate of claim 1, further comprising additional compact layers disposed on additional porous layers compact layer.

3. The coated steel substrate of claim 1, wherein the porous layer has a thickness from about 0.3 μm to about 3 μm and the compact layer has a thickness from about 0.3 μm to about 3 μm.

4. The coated steel substrate of claim 1, wherein the multiple-layer electroplated aluminum coating comprises from one to fifty porous layers and from one to fifty compact layers.

5. The coated steel substrate of claim 1, wherein the multiple-layer electroplated aluminum coating is configured to provide sacrificial corrosion protection of over 1,000 hrs under ASTM B 117.

6. The coated steel substrate of claim 1, wherein the multiple-layer electroplated aluminum coating passes a hydrogen embrittlement (HE) test performed according to ASTM F 519 using Type 1a.1 specimens having a notch.

7. The coated steel substrate of claim 1, wherein multiple-layer electroplated aluminum coating comprises a total thickness of about 10 μm to about 40 μm.

8. A coated steel substrate, comprising:

a high strength steel substrate; and a multiple-layer electroplated aluminum coating over the steel substrate, the multiple-layer electroplated aluminum coating comprising at least one porous layer and at least one compact layer, the at least one porous layer comprising a material selected from a group consisting of aluminum and aluminum alloys, and the at least one compact layer comprising a material selected from a group consisting of aluminum and aluminum alloys, wherein the at least one porous layer has a plurality of pores having a pore size of about 2 μm or more, wherein the at least one porous layer has a thickness from about 0.3 μm to about 3 μm, wherein the at least one compact layer has a thickness from about 0.3 μm to about 3 μm, and wherein the compact layer comprises a plurality of pores having a pore size of about 0.2 μm or less.

9. The coated steel substrate of claim 8, wherein the multiple-layer electroplated aluminum coating is configured to provide sacrificial corrosion protection of over 1,000 hrs under ASTM B 117.

10. The coated steel substrate of claim 8, wherein the multiple-layer electroplated aluminum coating passes a hydrogen embrittlement (HE) test performed according to ASTM F 519 using Type 1a.1 specimens having a notch.

11. The coated steel substrate of claim 8, wherein the at least one porous layer is electroplated by direct current and wherein the at least one compact layer is electroplated by pulsed current, wherein the multiple-layer electroplated aluminum coating is configured to provide corrosion resistance to the steel substrate in neutral water and in salt water.

12. The coated steel substrate of claim 8, wherein the multiple layer aluminum coating has a thickness from about 10 μm to about 40 μm and provides sacrificial corrosion protection.

13. A component, comprising:

a substrate;

an electroplated aluminum coating disposed over the substrate, wherein the electroplated aluminum coating is a multiple layer aluminum coating comprising at least one first electroplated aluminum layer, wherein the first electroplated aluminum layer comprises a plurality of pores having a pore size of about 2 μm or more, and at least one second electroplated aluminum layer disposed over the first electroplated aluminum layer, wherein the second electroplated aluminum layer comprises a plurality of pores having a pore size of about 0.2 μm or less, and the electroplated aluminum coating comprises a total thickness of about 10 μm to about 40 μm.

14. The component of claim 13, wherein the substrate is a steel substrate selected from the group consisting of low-carbon steel, medium-carbon steel, high-carbon steel, low-alloy steel, high-alloy steel, and combinations thereof.

15. The component of claim 14, wherein the electroplated aluminum coating comprises from one to fifty first electroplated aluminum layer layers and from one to fifty second electroplated aluminum layer layers.

16. The component of claim 15, wherein the at least one first electroplated aluminum layer has a thickness from about 0.3 μm to about 3 μm and the at least one second electroplated aluminum layer has a thickness from about 0.3 μm to about 3 μm.

17. The component of claim 16, wherein the electroplated aluminum coating is configured to provide sacrificial corrosion protection of over 1,000 hrs under ASTM B 117.

18. The component of claim 17, wherein the electroplated aluminum coating passes a hydrogen embrittlement (HE) test performed according to ASTM F 519 using Type 1a.1 specimens having a notch.

19. The component of claim 18, wherein the substrate is a part of any one or more of an aircraft, a spacecraft, a water-craft, a land vehicle, an engine, a propulsion structure, a space re-entry vehicle, a power-generation turbine, or any other metal component.

20. The coated steel substrate of claim 8, wherein the substrate is a steel substrate selected from the group consisting of low-carbon steel, medium-carbon steel, high-carbon steel, low-alloy steel, high-alloy steel, and combinations thereof.

* * * * *